US012331947B2

(12) United States Patent
Gerner et al.

(10) Patent No.: US 12,331,947 B2
(45) Date of Patent: Jun. 17, 2025

(54) ROOM UNIT FOR AN HVAC SYSTEM

(71) Applicant: BELIMO Holding AG, Hinwil (CH)

(72) Inventors: Pascal Gerner, Wetzikon (CH); Michael Bauernschmitt, Wetzikon (CH); Sebastian Eberle, Zürich (CH); Yoram Mottas, Fribourg (CH); Roman Kappeler, Uster (CH)

(73) Assignee: BELIMO Holding AG (CH)

( * ) Notice: Subject to any disclaimer, the term of this patent is extended or adjusted under 35 U.S.C. 154(b) by 0 days.

(21) Appl. No.: 18/287,008

(22) PCT Filed: Apr. 20, 2022

(86) PCT No.: PCT/EP2022/060447
§ 371 (c)(1),
(2) Date: Oct. 15, 2023

(87) PCT Pub. No.: WO2022/223637
PCT Pub. Date: Oct. 27, 2022

(65) Prior Publication Data

US 2024/0191897 A1 Jun. 13, 2024

(30) Foreign Application Priority Data

Apr. 22, 2021 (CH) ..... 00433/21

(51) Int. Cl.
*H05K 5/02* (2006.01)
*F24F 11/50* (2018.01)

(52) U.S. Cl.
CPC ..... *F24F 11/50* (2018.01)

(58) Field of Classification Search
CPC ..... H05K 5/0017; H05K 5/0217
(Continued)

(56) References Cited

U.S. PATENT DOCUMENTS 5,577,779 A 11/1996 Dangel
6,362,953 B1 3/2002 Ohlwine et al.
(Continued)

FOREIGN PATENT DOCUMENTS

EP 2312711 A2 4/2011
KR 10-2006-0005234 1/2006
KR 20150004185 U * 11/2015 ..... G01K 1/08

OTHER PUBLICATIONS

English language translation of KR 10-2006-0005234 A.
(Continued)

*Primary Examiner* — Hung S. Bui
(74) *Attorney, Agent, or Firm* — Lerner David LLP

(57) ABSTRACT

A room unit for an HVAC system is disclosed including a connection means to connect the device to the HVAC system, a controller and a housing. The housing includes a mounting plate for installing a room unit on a wall of a building. The mounting plate includes a base plate with a circumferential rim projecting away perpendicularly from the base plate. The mounting plate includes at least one first protrusion projecting away from an outer surface of the rim in a direction parallel to the base plate. The housing frame includes a circumferential side wall that laterally surrounds the inside of the room unit. The side wall is configured to receive the rim of the mounting plate with positive fit. The housing frame includes at least one second protrusion projecting away from an inner surface of the side wall towards an opposite inner surface of the housing frame.

20 Claims, 6 Drawing Sheets

(58) Field of Classification Search
USPC ..... 361/730
See application file for complete search history.

(56) References Cited

U.S. PATENT DOCUMENTS

| | | | | |
|---|---|---|---|---|
| 6,606,252 | B1 * | 8/2003 | Snider | H05K 1/0268 174/262 |
| 8,045,337 | B2 * | 10/2011 | Morales | E05B 77/34 361/801 |
| 2003/0136780 | A1 * | 7/2003 | Sato | H02G 3/088 220/849 |
| 2005/0270151 | A1 * | 12/2005 | Winick | G08B 17/00 340/539.1 |
| 2011/0226506 | A1 * | 9/2011 | Hamilton | H05K 5/0017 174/59 |
| 2019/0005809 | A1 * | 1/2019 | Dimberg | H05B 45/00 |
| 2019/0317177 | A1 * | 10/2019 | Ertan | G01S 3/46 |
| 2019/0341760 | A1 | 11/2019 | Okura et al. | |

OTHER PUBLICATIONS

English language translation of EP 2 312 711 A2.
Search Report from the Swiss Patent Office for CH4332021 requested Jun. 3, 2021.
International Search Report for PCT/EP2022/060447 mailed Aug. 8, 2022.

* cited by examiner

ROOM UNIT FOR AN HVAC SYSTEM

CROSS-REFERENCE TO RELATED APPLICATIONS

The present application is a national phase entry under 35 U.S.C. § 371 of International Application No. PCT/EP2022/060447, filed Apr. 20, 2022, published in English, which claims priority to Swiss Application No. 0433/21, filed Apr. 22, 2021.

BACKGROUND OF THE INVENTION

Field of the Invention

The invention relates to room unit for an HVAC system comprising a connection means to connect the device to the HVAC system, a controller and a housing whereby the housing comprises a mounting plate for installing the room unit on a wall of a building, a housing frame, which is attachable to the mounting plate, at least one mechanical connector, and a front housing part. Furthermore, the invention is concerned with a method for installing a room unit on a wall of a building.

Description of Related Art

Heating, ventilation, and air conditioning (HVAC) systems are in use in many public buildings, such as schools, shops, etc., industrial buildings, in office buildings as well as in private homes. Such systems usually include a room unit, in particular a room control unit or a room sensor, in each controlled room, space or zone of the building, which allows to measure and/or set values, such as e.g. room temperature, ventilation intensity, by users. The room units usually comprise sensors, which measure certain air parameters in the room, space or zone, such as ambient temperature, relative humidity and/or the $CO_2$ content, in order to provide the parameters to a central control of the HVAC system. The room units may further comprise screens to display information about the set values and the measured parameters.

Typically, room units for HVAC systems are mounted to a wall of a building in the controlled room, space or zone. Thereby, room units often have a mounting plate sub-assembly that is mounted to the wall, and a removable sub-assembly portion that is removably mounted to the mounting plate sub-assembly. Such a setup is beneficial for installation and maintenance of the room unit. For example, when installing the room unit, the mounting plate is freely accessible what simplifies the mounting to the wall and electrical cables of the HVAC system can be passed through cable inlets and/or attached to electrical connectors on the mounting plate more easily.

US 2014/0226286 A1 (Honeywell International Inc.) describes for example a wall-mountable room unit including a removable controller module and a wall plate, with a hinge that allows the controller module to rotate relative to the wall plate. The hinge provides an end stop that limits the rotation of the controller module relative to the wall plate, and/or may allow the controller module to be freely pulled away and disengaged from the wall plate if desired.

However, in this setup the bulky and protruding hinge element on the wall plate can easily break of during installation due to its exposed position. This can for example happen if the hinge is hit by a tool or the like, or if the controller module is pressed onto the wall plate without the hinge element of the controller module being properly introduced into the corresponding hinge element of the wall plate. Additionally, when reopening the room unit with too much force, the hinge might break as well.

Another issue with room units comprising temperature sensors is that the heat generated by microprocessors or other electronic components, which are part of the controller of the room unit, can affect temperature measurement such that the temperature measured may not accurately reflect the ambient room temperature. In order to reduce this undesired effect, temperature sensors frequently are thermally isolated from the other electronic components.

In this regard, U.S. Pat. No. 8,197,130 B2 (Siemens) describes for example a temperature sensing device with a housing comprising thermally isolating partition walls at the inside that are configured to thermally isolate the temperature sensor from the residual electronic components. Additionally the printed circuit board of the unit comprises a machined slot between the temperature sensor and the residual electronic components for reducing heat transfer through the printed circuit board.

However, thermal isolation of the temperature sensor might negatively affect response times of the temperature sensor upon temperatures changes in the controlled room, space or zone.

Thus, there is still a need to develop improved room units for HVAC systems which at least partly overcome the disadvantages mentioned above.

BRIEF SUMMARY OF THE INVENTION

It is an object of the invention to provide an improved room unit. Especially, a room unit as compact in size and as easy to install and maintain as possible is to be provided. In particular the room unit should be resistant in case of incorrect handling during installation and maintenance at the best. Preferably, despite the compact size, the room unit furthermore should be capable to reliably measure ambient air parameters, especially ambient temperature, in the controlled room, space or zone of a building.

A first solution of the invention is specified by the features of claim 1. According to this solution, a room unit for an HVAC system comprises a connection means to connect the device to the HVAC system, a controller and housing, whereby the housing comprises:

- a mounting plate for installing the room unit on a wall of a building, whereby the mounting plate comprises a base plate with a circumferential rim projecting away perpendicularly from the base plate, and whereby the mounting plate comprises at least one first protrusion projecting away from an outer surface of the rim in a direction parallel to the base plate;
- a housing frame, which is attachable to the mounting plate, whereby the housing frame comprises a circumferential side wall, which laterally surrounds the inside of the room unit, and whereby the side wall is configured for receiving the rim of the mounting plate with positive fit; whereby the housing frame comprises at least one second protrusion projecting away from an inner surface of the side wall towards an opposite inner surface of the housing frame;

whereby the at least one first protrusion of the mounting plate and the at least one second protrusion of the housing frame are configured in such a way that they can interlock with each other with a positive fit when the rim of the mounting plate is at least partly received in the circumferential side wall of the mounting frame;

at least one mechanical connector at a side opposite the at least one first and second protrusions, for securing the housing frame to the mounting plate when the at least one first and the second protrusions are interlocked in positive fit and the rim of the mounting plate is entirely received in the mounting frame, and a front housing part, which is configured for closing the housing frame at a free end opposite the mounting plate.

In particular, in the present context, the housing frame may also be referred to as mounting frame.

Due to the special arrangement of the at least one first protrusion on the rim of the mounting plate and at least one second protrusion on an inner surface of the housing frame, the room unit can be designed much more compact. Furthermore, due to the inventive orientation of the at last one first and the at least one second protrusion, which both project in a direction parallel to the base plate or the mounting wall, respectively, the projections are less exposed resulting in a reduced risk of breaking during installation and/or during maintenance.

For attaching the housing frame to the mounting plate, the housing frame can loosely be interlocked with its at least one second protrusion with the at least first protrusion of the mounting plate, then rotated onto the opposite site fixed with the at least one mechanical connector. Because the side wall of the housing frame is configured for receiving the rim of the mounting plate with positive fit in connected state, a highly robust connection between the two housing elements is obtained. Thus, even if a force is applied onto the outer side of the side wall of the housing frame, there is essentially no risk that the connection between the housing frame and the mounting plate is released.

When reopening the room unit by detaching the housing frame from the mounting plate, there is essentially no risk to break the protrusions, neither the at least one first protrusion nor the at least one second protrusion because the protrusions can easily disengage once the at least one mechanical connector has been released.

Also, due to the inventive orientation of the at last one first and the at least one second protrusion, which both project in a direction parallel to the base plate or the mounting wall, the protrusions can be designed such that when pressing the housing frame onto the mounting plate with the protrusions in non-interlocked position, the at least one second protrusion can slip over the at last one first protrusion. This can for example be achieved with by a certain flexibility of the rim and/or the side wall allowing the protrusions to slide around each other. Consequently, the risk of breaking during installation and/or maintenance is significantly reduced.

The front housing part can be designed depending on the demands on the specific room unit. For example, the front housing part can comprise a display, one or more input devices, e.g. a button or a switch, or it can be in the form of blind cover without any further function.

Especially, one and the same mounting plate and housing frame can be combined with different front housing parts. This allows for a highly efficient production of room units for different applications.

As understood in the present application, a room unit is a device which is placed in a room, a space or a zone of a building having an HVAC system in order to supply data to the HVAC system, in particular to rely values set by a user on the room unit to the HVAC system and/or to rely current air parameters measured in a room, space or zone to the HVAC system. For example, the HVAC system then changes its operating parameters such as to match the set values for the particular room, space or zone. Thus, in the present context, the term "room unit" is to be interpreted broadly and encompasses room control units as well as room sensors.

In particular, the mounting plate, the housing frame and the front housing part preferably all are separate parts, in particular to have maximum flexibility during assembly. However, for example, the housing frame and the front housing part can be provided in the form of one component, if desired.

Especially, with respect to an installed state of the room unit, the at least one first protrusion of the mounting plate is located on an upper outer surface of the rim and the at least one second protrusion of the housing frame is located on an upper inner surface of the side wall. Given this, the housing frame can be hooked onto the mounting plate during the assembly process what greatly simplifies installation.

In particular, with respect to an installed state of the room unit, the at least one mechanical connector is located at a bottom side of the housing. This allows the mechanical connector to be hidden at the bottom side. Furthermore, in combination with the above mentioned arrangement of the protrusions at the upper surfaces, the housing frame is reliably secured to the mounting plate at opposite sides of the housing.

However, in principle, the protrusions and/or the at least one mechanical connector can be placed on other sides of the room unit for special applications.

Most preferably, the at least one mechanical connector comprises a snap-in connector with a first connection element arranged at the mounting plate, especially at the rim, and a second connection element arranged at the housing frame, especially at the side wall of the housing frame. This allows for a tool-free connection between mounting plate and housing frame what greatly simplifies installation.

Especially, the at least one mechanical connector comprises at least one screw, in particular at least two screws, which allows for securing the housing frame to the mounting plate. With a screw as the at least one mechanical connector, the connection can be secured even more reliably.

Especially, the at least one screw, in particular the at least two screws, are configured as captive screw(s). Thus, preferably, the at least one screw comprises a securing element for securing the screw to the housing frame and/or the mounting plate. This can be achieved, for example, with a retaining ring and/or a thread lock. However, other securing elements can be used as well.

Preferably, the at least one screw is arranged in the rim of the mounting plate, especially in a nut, and the housing frame comprises at least one bore, whereby in a first position the screw is fully located below an outer surface of the rim of the mounting plate and in a second position the screw protrudes outside the outer surface of the rim, whereby, if the rim of the mounting plate is received in the housing frame and the screw is brought into the second position, the at least one screw protrudes into the at least one bore for securing the housing frame to the mounting plate.

Most preferred the at least one mechanical connector comprises a snap-in connector as described above and at least one screw as described above. This configuration at the same time simplifies installation and results in a highly stable and secure connection between housing frame and the mounting plate.

In a preferred embodiment, the rim is offset inwards from a circumferential edge of the base plate, in particular by a thickness of the side wall of the mounting frame. Thereby, the protruding edge of the base plate forms a flange, which can serve as a stop for the side wall of the housing frame. Overall, the offset of the rim helps to define the relative orientation between housing frame and to increase stability of the connection between housing fame and mounting plate.

Nevertheless, such an offset is optional and can be omitted if desired.

According to a highly preferred embodiment, the mounting plate and the housing frame are configured such that the first and the second protrusions can be interlocked in a positive manner while the housing frame stands off at an angle with respect to the base plate, especially an angle of 5-45, and the housing frame can be pivoted around the interlocked protrusions, in order to entirely receive the rim of the mounting plate and to secure the housing frame to the mounting plate with the mechanical connector, especially the snap-in connector and/or the at least one screw. Thus, with such a design, the housing frame can smoothly be pivoted onto the mounting plate in a well-defined manner without need for large forces.

This can for example be realized by suitable tolerances, especially the tolerance of the positive fit between the rim of the mounting plate and the circumferential side wall, allowing the above described pivoting motion. For example, a length of the rim of the mounting plate in a direction from the at least one first protrusion to the mechanical connector is smaller than an inner length of the circumferential side wall in a direction from the at least one second protrusion to the least one mechanical connector.

Alternatively or in addition, the mounting plate and the housing frame are configured such that, if the housing frame is pressed onto the mounting plate in a direction perpendicular to the base plate and with an orientation parallel to the base plate, the at least one first protrusion snaps on the at least one second protrusion in order to interlock the protrusions in a positive manner and simultaneously the rim of the mounting plate is received in the circumferential side wall of the mounting frame such that the housing frame is or can be secured to the mounting plate. Thus, even if the above described pivoting motion is not followed, the housing frame can reliably be fixed on the mounting plate.

Most preferably, the mounting plate and the housing frame are configured such that both, the above described connection by pivoting the housing frame as well as by pressing of the housing frame in a direction perpendicular to the base plate, are possible. In this case, there, the risk to damage the housing upon installation is further reduced.

In particular, the at least one first protrusion, at a side opposite the base plate, has a sloped surface, which preferably slopes in a direction away from the outer surface of the rim and/or the at least one second protrusion, at a side facing the mounting plate, has a sloped surface, which preferably slopes in a direction away from the side wall. Sloped surfaces enables the housing frame to slip-over the mounting plate if the housing frame is pressed onto the mounting plate in a direction perpendicular to the base plate and with an orientation parallel to the base plate. However, instead of or in addition to sloped surfaces, the tolerances between housing frame and mounting plate might be increased.

In another preferred embodiment, the at least one first protrusion, in a direction parallel to the base plate, does not tower over the base plate and/or the at least one second protrusion is flush with an edge of the side wall. This configuration reduces the risk of damage during installation since the sensitive protrusions are better protected by the mounting plate and/or the housing frame. In other embodiments, however, the protrusions might be designed differently.

In another embodiment, the rim of the mounting plate and/or the side wall of the housing frame comprises a break-out section, especially fixed with at least one predetermined breaking point, in particular for obtaining a cable passage. This allows the room unit for example to be used as a surface-mounted unit, whereby the break-out section preferably is removed from the mounting plate and/or the side wall of the housing frame for introducing a connection cable, as well as a unit mounted on a flush-mounted box, whereby the break-out section remains in the mounting plate and/or the side wall of the housing frame. In the latter case, a connection cable from the flush-mounted box can for example be introduced into the room unit through a break-through in the base plate. Thereby, the break-out sections help to increase the stability of the mounting plate when being mounted over the flush-mounted box and the stability of the housing frame. However, break-out section are optional elements, which can be omitted if desired.

Especially, the controller is arranged on a printed circuit board. Typical printed circuit boards are robust and can be fixed in the housing in a space saving manner.

Furthermore, the room unit preferably comprises at least one sensor to measure at least one parameter of ambient air, especially temperature, humidity, a concentration of $CO_2$, volatile organic compounds (VOC) and/or particulate matter.

More preferably, the room unit comprises:

the controller arranged on a first printed circuit board;

and at least one temperature sensor to measure the temperature of ambient air, whereby the at least one temperature sensor is arranged on a frontside of a second printed circuit board;

wherein the second printed circuit board protrudes from the first printed circuit board, especially in a direction perpendicular to the first printed circuit board;

whereby the second printed circuit board is arranged such that a backside of the second printed circuit board in physical contact with an inner surface of the housing.

The combination of the at least one temperature sensor arranged on a frontside of a second printed circuit board, which protrudes from the first printed circuit board and which is in physical contact via its backside with the inner surface of the housing turned out to be highly beneficial. With this setup the temperature sensor is thermally decoupled from the heat generating elements, e.g. microprocessors or other electronic components, which are part of the controller of the room unit. At the same time, the temperature of the housing of the room unit, which essentially corresponds to the temperature of the ambient air in the controlled room, space or zone is efficiently coupled to the second printed circuit board or the temperature sensor, respectively. This allows to obtain fast response times upon temperatures changes in the controlled room, space or zone.

Consequently, the inventive setup allows to accurately measure the ambient room temperature essentially independently of the heat evolution of the controller on the first printed circuit board.

Furthermore, the inventive arrangement is obtainable with established standard assembly methods for printed circuit boards. Put differently, there is no need for complex manufacturing processes or even manual labor. Hence, the inventive arrangement can be produced in a highly efficient and cost effective manner.

Especially, the second printed circuit board is fixed, especially soldered and/or plugged, on the first printed circuit board, in particular with at least one or more pin connectors. Preferably, there are at least two, three, or more pin connectors. Pin connectors preferably are electrical connectors. This allows for a compact and mechanically stable connection between the two circuit boards. However, other setups are possible as well.

According to a preferred embodiment, the backside of the second printed circuit board comprises a heat conductive coating, which is in contact with the inner surface of the housing. In this case, the heat conductive coating of the second printed circuit board acts as a thermal bridge between the second printed circuit board and the housing. This greatly enhances the thermal coupling between the housing and the second printed circuit board or the temperature sensor, respectively, which in turn improves response times upon temperatures changes in the controlled room, space or zone.

However, depending on the specific application, the coating can be omitted in order to simplify the setup.

Preferably, the heat conductive material is a material with a thermal conductivity (λ) of at least 10 W/(m·K), preferably at least 100 W/(m·K), in particular at least 200 W/(m·K), whereby the thermal conductivity is measured at 0 C, at a pressure of 1.013 bar and a humidity of 50%.

Especially, the heat conductive material is a metallic material, in particular comprising or consisting of copper, aluminum, silver and/or gold. These materials feature a relatively high thermal conductivity while being mechanically and chemically stable for use as a coating in the inventive room unit. Nevertheless, other materials can be suitable as well.

If present, the coating of the heat conductive material preferably covers at least 50%, especially at least 75%, in particular at least 90%, of the backside area of the second printed circuit board.

Preferably, a thickness of the coating of the heat conductive material is 0.001-1 mm, especially 0.01-0.5 mm, in particular 0.02-0.05 mm.

This results in a highly effective coupling between housing and second printed circuit board. However, the area share of the heat conductive coating can be below 50% and/or the thickness can be chosen differently, if desired for specific embodiments.

According to a further preferred embodiment, at least one humidity sensor to measure the humidity of ambient air is additionally arranged on the second printed circuit board. Also for these kind of sensors, reliable temperature conditions are important. Of course, the second printed circuit board might comprise further sensors.

In particular, a combined sensor for measuring temperature and humidity of ambient air is arranged on the second printed circuit board. This results in a space-saving structure and an easier readout of the sensors.

Especially, the at least one temperature sensor, the at least one humidity sensor and/or the combined sensor is an active sensor. In the present context, an active senor is meant to be a sensor device that is powered with input energy from a source other than that which is being sensed for delivering an output signal. In contrast, a passive sensor works without input energy. If desired, the invention can be implemented with passive sensors as well.

In a further preferred embodiment, a further sensor for measuring a further parameter of ambient air is arranged on the first printed circuit board, especially the further sensor is a sensor for measuring a concentration of $CO_2$, volatile organic compounds (VOC) and/or particulate matter. These kind of sensors, typically produce a considerable amount of heat during operation. Therefore, it is beneficial to arrange them on the first printed circuit board, i.e. thermally decoupled from the second printed circuit board comprising the temperature sensor.

However, a further sensor for measuring a further parameter of ambient air arranged on the first printed circuit board sensors is optional.

Preferably, the second printed circuit board is located at an edge of the first printed circuit board. This allows for a direct contacting of the second printed circuit board and the inner surface of the housing by placing the first printed circuit board nearby the inner surface. Additionally, the second printed circuit board can be separated as far as possible from the heat generating components on the first printed circuit board. However, other setups are possible as well. For example, the second printed circuit board can be located on a more central section of the first printed circuit board. In this case, the housing might feature an inner bulge for contacting the second printed circuit board.

Preferably, with respect to an installed state of the room unit,

- the controller is spaced in horizontal direction from the second printed circuit board, whereby, preferably, in horizontal direction the controller is located in the other half of the first printed circuit board than the second printed circuit board; and/or
- the controller is spaced in vertical direction from the second printed circuit board, whereby, preferably, the controller is located above the second printed circuit board; and/or
- the second printed circuit board is located in a lower half of the first printed circuit board; and/or if present, the further sensor for measuring a further parameter of ambient air, with respect to an installed state of the room unit, is arranged in a section of the first printed circuit board in vertical direction above the second printed circuit board.

With these measures, the second printed circuit board can optimally be separated from heat generating components on the first printed circuit board. Thereby, if the second printed circuit board is located in vertical direction below the heat generating components, ascending heat produced by these components will not flow around the second printed circuit board. Nevertheless, other setups are possible as well.

Especially, in a first section of the first printed circuit board, in which the second printed circuit board is installed,

- there is no metallic ground plane on or within the first printed circuit board; and/or
- a surface area of metallic connection lines and/or metallic ground planes on or within the first printed circuit board is below 50%, especially below 25%, in particular below 10%, with respect to the total surface area of the first section; and/or
- the first section is separated from a second section of the first printed circuit board, in which the controller is located, by at least one slit-shaped opening in the first printed circuit board, especially for thermally decoupling the two sections.

In a further preferred embodiment, the first printed circuit board comprises a third section in which the at least one further sensor is located, whereby, the third section is separated from the first and/or the second section by at least one further slit-shaped opening in the first printed circuit board, especially for thermally decoupling the third section from the first and/or the second section.

In the embodiments described above, the first section preferably has a surface share of 5-50%, especially –30%, in particular 10-20%, with respect to the total surface area of the first printed circuit board.

These measures, each one alone and even more in combination with each other, help to further thermally decouple the second printed circuit board from the first printed circuit board.

Especially, the housing frame comprises a support structure, especially a tray, for carrying the controller or the printed circuit board, especially the first printed circuit board, with the controller arranged on it within an inner volume surrounded by the side wall, especially on a side of the support structure facing away from the wall and/or the mounting plate.

The support structure preferably defines a fixed position of the circuit boards in the housing. If the support structure is present in the above mentioned housing frame, the first printed circuit board with the second printed circuit board can be installed beforehand on the support structure and later on attached to the mounting plate. This greatly simplifies installation and maintenance.

Especially, the support structure covers 50-100%, especially 70-90%, of the cross-sectional area of the inner volume surrounded by the side wall of the housing frame. This allows for dividing the housing into two distinct volumes, such that, for example, the circuit boards can be protected against undesired forces during installation.

The printed circuit board, especially the first printed circuit board, preferably comprises one or more pin connectors, in particular for connecting the controller to the connection means.

In this case, preferably, the mounting plate comprises the connection means to connect the device to the HVAC system, especially a connector for a bus system, especially a field bus system, and/or a socket which is configured for receiving the one or more pin connectors of the printed circuit board, especially the first printed circuit board.

Most preferably, the pin connectors of the printed circuit board, especially the first printed circuit board, and the connection means are configured such that the one or more pin connectors can be inserted or are inserted into the socket, especially through openings in the support structure, especially in a direction perpendicular to the mounting plate.

This allows for an easy and safe installation since the printed circuit board, especially the first printed circuit board, can simply be pressed on the connection means for establishing a connection.

The front housing part preferably is a separate part of the housing which is configured to be fixed on the housing frame, especially with at least one snap-in connector.

According to a preferred embodiment, the front housing part comprises a display, preferably an electronic paper display, especially covered with a transparent cover. This allows to display information about the set values and the measured parameters.

In particular, the display is a touch-screen or is overlaid by a touch sensitive foil. Such a display can be used as an input device to set values, such as e.g. a desired room temperature, ventilation intensity, etc., by users.

In another preferred embodiment, the front housing part is a blind cover. In this case, no display is present and the room unit is intended to function without user input or user input is provided via other input devices, e.g. wireless communication modules.

Furthermore, the room unit preferably comprises a short-range wireless communication module which allows wireless communication with a mobile device for the exchange of data between the mobile device and the room unit, and vice versa.

Further preferred, the room unit comprises an antenna for wireless communication, especially, an antenna of the above mentioned short-range wireless communication module.

Most preferably, the antenna is arranged behind the display, especially in physical contact with the backside of the display. In particular the antenna can be in loose contact with the display or the antenna is attached to a backside of the display. In a special embodiment, the antenna is materially bonded to the backside of the display, especially adhesively bonded to the backside of the display.

Arranging the antenna behind the display turned out to be highly beneficial. Thereby the antenna can be attached to the backside of the display. This simplifies installation and protects the antenna during installation and maintenance. Nevertheless, electromagnetic waves typically used for short-range wireless frequencies sufficiently penetrate displays as they usually are used for room units. Additionally, the antenna is optimally placed in the room unit for establishing a reliable connection with a mobile device. As it turned out, users intuitively tend to hold a mobile device in front of a display. Thus, if the antenna is located behind the display, the chances to obtain a reliable connection in a first attempt are highly improved. The arrangement of the antenna behind the display therefore results in a synergistic effect.

If the front housing part is a blind cover, the antenna preferably is in physical contact or attached to the backside or the inner side, respectively, of the blind cover.

Preferably the antenna is a planar antenna, especially a microstrip antenna and/or a foil antenna, in particular comprising conductive antenna elements in and/or on a substrate in the form of a plastic foil. Such antennas are rather robust and compact.

Especially, the outer dimensions of the antenna are equal to or smaller than the size of the display. Thus, in this case the antenna is fully covered by the blind cover or the display, resulting in maximum protection.

According to a further preferred embodiment, the antenna is a planar frame-shaped antenna, especially with a shape and an outer dimension equal to the outer dimension of the display or the inner dimension of the blind cover. Antennas with such shapes can cover the whole area of the front housing part and/or the display and ensure a good connection with a mobile device even if it is positioned at an edge of the housing and/or display.

In another embodiment, the antenna can have the form of a planar rectangular sheet.

Further preferred, the front housing part comprises a frame element for carrying the display, the transparent cover, the touch sensitive foil, and/or the antenna, whereby, preferably, the frame element comprises snap-in connection means for connection the frame element to the housing frame. Such a frame element supports and protects the stack of components.

Especially, the controller comprises a microcontroller or microprocessor as well as at least one memory. In installed state, the controller is in particular electrically connected to the connection means, especially via the pin connectors. If present, the controller furthermore can be connected to the display, the second printed circuit board, the at least one sensor and/or the at least one further sensors.

In particular, the controller is configured to send data to and receive data from the HVAC system. Furthermore, the controller can be configured for presenting data on the display, if present, and/or reading data from an input device, if present. The data comprises for example temperature data, humidity data, $CO_2$ data, data on particulate matter and/or ventilation data.

A further aspect of the present invention is directed to a method for installing a room unit as described above comprising the steps of:

Fixing the mounting plate on a wall of a building, whereby the mounting plate is arranged such that the at least one first protrusion of the mounting plate is located on an upper outer surface of the rim;

Attaching the housing frame at the upper side of the mounting plate, such that the at least one second protrusion of the housing frame interlocks with the at least on first protrusion in a positive manner and the housing frame stands off the mounting plate at an angle;

Pivoting the housing frame around the interlocked protrusions in order to entirely receive the rim of the mounting plate;

Securing the housing frame to the mounting plate with the mechanical connector; and Attaching the front housing part to the housing frame and thereby closing the housing frame at the free end opposite the mounting plate.

As far as meaningful, steps a) to e) can be performed in any order. For example, steps a) to e) can be performed in the given order. Another possibility is for example to first perform step e) and then steps a) to d) in the given order.

Advantages described above in connection with the room unit are likewise given with regard to the inventive method. Preferably, the above described preferred embodiments and features of the room unit are realized as well when implementing the inventive method.

A second solution of the invention is described in the following. The second solution, which is independent of the above described first solution, is related to a room unit for an HVAC system comprising a controller, a housing and a short-range wireless communication module which allows wireless communication with a mobile device for the exchange of data between the mobile device and the room unit, and vice versa, whereby the unit furthermore comprises a display, whereby the display is a touch screen or the display is overlaid by a touch sensitive foil, and whereby an antenna of the short-range wireless communication module is arranged behind the display.

In case of the second solution, the housing not necessarily comprises a mounting plate, a housing frame and a front housing part as described above. Rather the housing can have any kind of design.

According to a preferred embodiment, the display is an electronic paper display, especially covered with a transparent cover.

In particular, the display is a touch-screen or is overlaid by a touch sensitive foil. Such a display can be used as an input device to set values, such as e.g. a desired room temperature, ventilation intensity, etc., by users.

Especially, the antenna can be in loose contact with the display or the antenna is attached to a backside of the display. In a special embodiment, the antenna is materially bonded to the backside of the display, especially adhesively bonded to the backside of the display.

Preferably the antenna is a planar antenna, especially a microstrip antenna and/or a foil antenna, in particular comprising conductive antenna elements in and/or on a substrate in the form of a plastic foil. Such antennas are rather robust and compact.

Especially, the outer dimensions of the antenna are equal to or smaller than the size of the display. Thus, in this case the antenna is fully covered by the display, resulting in maximum protection.

According to a further preferred embodiment, the antenna is a planar frame-shaped antenna, especially with a shape and an outer dimension equal to the outer dimension of the display. Antennas with such shapes can cover the whole area of the display and ensure a good connection with a mobile device even if it is positioned at an edge of the housing and/or display.

In another embodiment, the antenna can have the form of a planar rectangular sheet.

Furthermore, the room unit preferably comprises at least one sensor to measure at least one parameter of ambient air, especially temperature, humidity, a concentration of $CO_2$, volatile organic compounds (VOC) and/or particulate matter.

Further preferred, the housing comprises a frame element for carrying the display, the transparent cover, the touch sensitive foil, and/or the antenna, whereby, preferably, the frame comprises snap-in connection means for connection the frame element to the housing frame. Such a frame element supports and protects the stack of components.

Especially, the controller is arranged on a printed circuit board. Typical printed circuit boards are robust and can be fixed in the housing in a space saving manner.

Especially, the controller comprises a microcontroller or microprocessor as well as at least one memory. In installed state, the controller is in particular electrically connected to the connection means, especially via the pin connectors. If present, the controller furthermore can be connected to the display, the second printed circuit board, the at least one sensor and/or the at least one further sensors.

In particular, the controller is configured to send data to and receive data from the HVAC system. Furthermore, the controller can be configured for presenting data on the display, if present, and/or reading data from an input device, if present. The data comprises for example temperature data, humidity data, $CO_2$ data, data on particulate matter and/or ventilation data.

Advantages described above in connection with the features of the first solution are likewise given with regard to the respective features of the second solution.

Other advantageous embodiments and combinations of features come out from the detailed description below and the entirety of the claims.

BRIEF DESCRIPTION OF THE SEVERAL VIEWS OF THE DRAWINGS

Further advantages features and details of the various embodiments of this disclosure will become apparent from the ensuing description of a preferred exemplary embodiment or embodiments and further with the aid of the drawings. The features and combinations of features recited below in the description, as well as the features and feature combination shown after that in the drawing description or in the drawings alone, may be used not only in the particular combination recited but also in other combinations on their own without departing from the scope of the disclosure. The following is an advantageous embodiment of the invention with reference to the accompanying figures, wherein.

In the figures, the same components are given the same reference symbols.

DETAILED DESCRIPTION OF THE INVENTION

Figure 1:
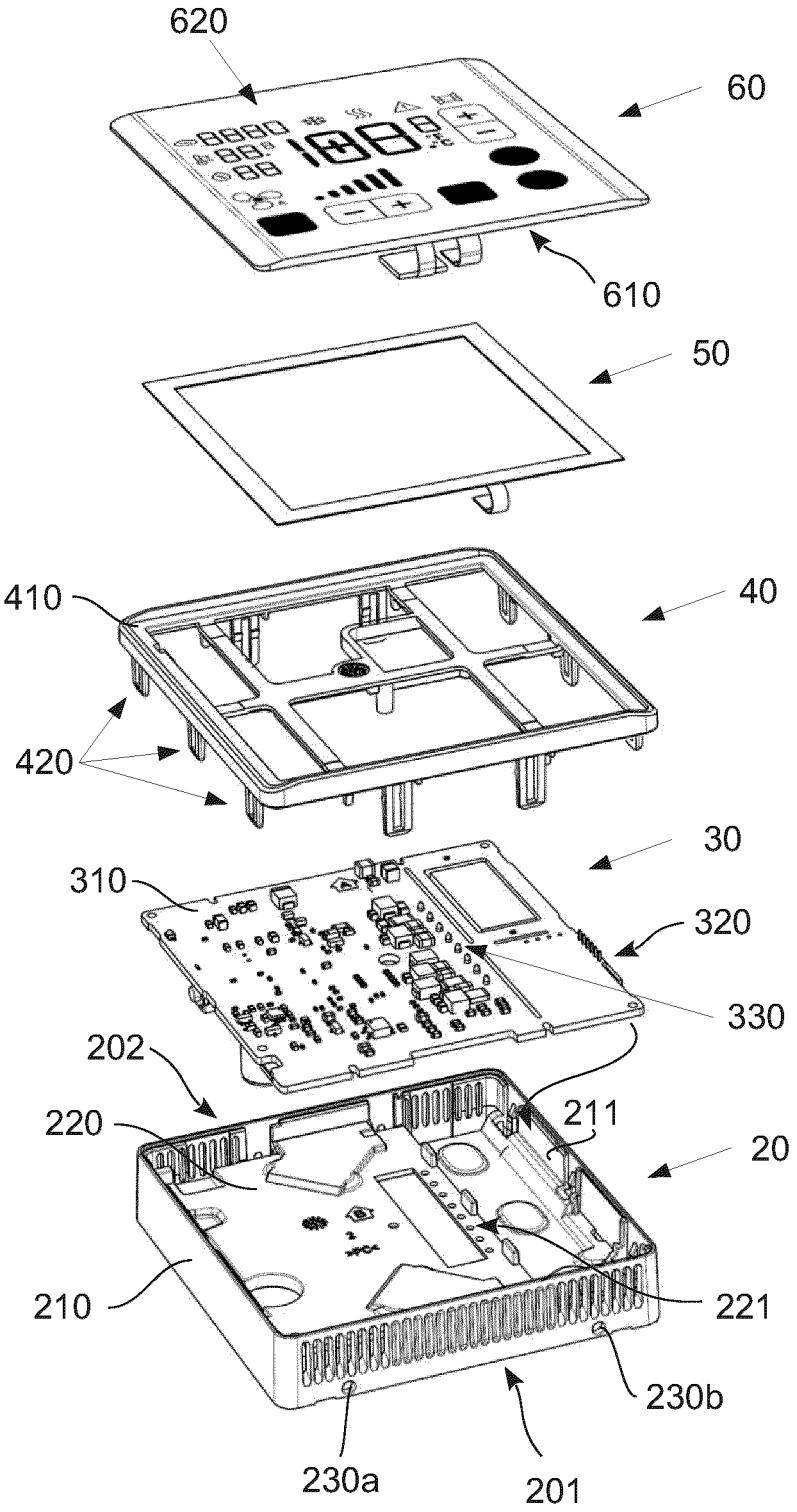
FIG. 1 depicts an exploded perspective view of a housing frame, a printed circuit board, a frame element, a planar frame-shaped antenna for wireless communication and an electronic paper display with touch functionality, for use in a room unit.

The subject-matter described in the following will be clarified by means of a description of those aspects which are depicted in the drawings. It is however to be understood that the scope of protection of the invention is not limited to those aspects described in the following and depicted in the drawings; to the contrary, the scope of protection of the invention is defined by the claims. Moreover, it is to be understood that the specific conditions or parameters described and/or shown in the following are not limiting of the scope of protection of the invention, and that the terminology used herein is for the purpose of describing particular aspects by way of example only and is not intended to be limiting.

Unless otherwise defined, technical and scientific terms used herein have the same meaning as commonly understood by one of ordinary skill in the art to which this invention belongs. Further, unless otherwise required by the context, singular terms shall include pluralities and plural terms shall include the singular. The methods and techniques of the present disclosure are generally performed according to conventional methods well known in the art and as described in various general and more specific references that are cited and discussed throughout the present specification unless otherwise indicated. Further, for the sake of clarity, the use of the term "about" is herein intended to encompass a variation of +/−10% of a given value.

Non-limiting aspects of the subject-matter of the present disclosure will be described by way of example with reference to the accompanying figures, which are schematic and are not intended to be drawn to scale. For purposes of clarity, not every component is labelled in every figure, nor is every component of each aspect of the invention shown where illustration is not necessary to allow those of ordinary skill in the art to understand the invention.

The following description will be better understood by means of the following definitions.

As used in the following and in the appended claims, the singular forms "a", "an" and "the" include plural referents unless the context clearly dictates otherwise. Also, the use of "or" means "and/or" unless stated otherwise. Similarly, "comprise", "comprises", "comprising", "include", "includes" and "including" are interchangeable and not intended to be limiting. It is to be further understood that where for the description of various embodiments use is made of the term "comprising", those skilled in the art will understand that in some specific instances, an embodiment can be alternatively described using language "consisting essentially of" or "consisting of."

Figure 12:
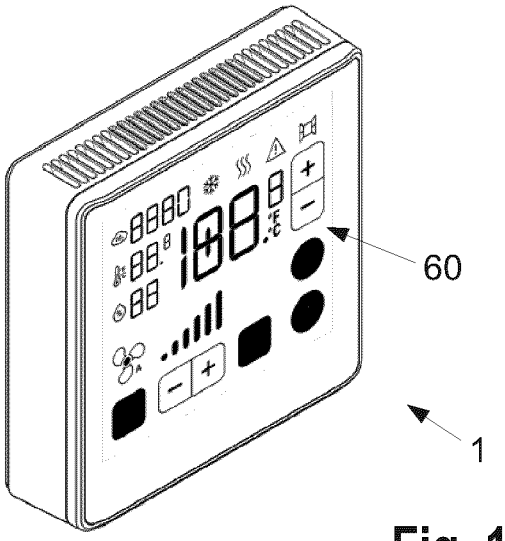
FIG. 12 depicts a perspective view of a room unit comprising the components as shown in FIG. 1-11 in assembled state.

FIG. 1 shows an exploded view of a housing frame 20, a printed circuit board 30, a frame element 40, a planar frame-shaped microstrip antenna 50 for wireless communication and an electronic paper display 60 with touch functionality, which are components of a first room unit 1 as shown in FIG. 12.

The housing frame 20 comprises a circumferential side wall 210 enclosing an inner volume of the housing frame 20. The side wall 210 comprises two bores 230*a*, 230*b* next to slit-shaped air vents at a bottom side 201 (in vertical direction with respect to the installed state) for fixing the housing frame 20 on a mounting plate 10 (see FIGS. 2-4). The upper side 202 (in vertical with respect to the installed state) opposing the bottom side 201 comprises further slit-shaped air vents.

The inner volume of the housing frame 20 is divided into a lower part and an upper part with a tray-like support structure 220 with several breakthroughs for receiving the printed circuit board 30.

The printed circuit board 30 comprises a first printed circuit board 310 and a second printed circuit board 320 protruding from an edge of the first printed circuit board 310 in a direction perpendicular to the first printed circuit board 310. In a central part, there are 8 pin connectors 330 protruding in a direction towards the housing frame 20 (in FIG. 1 only the backside ends of the pin connectors are visible). Further details of the printed circuit board 30 and the arrangement in the housing frame 20 are given in FIG. 8-11.

As section of the inner surface 211 of the side wall 210 of the housing frame 20 is configured for contacting the second printed circuit board 320 in assembled state. In a central part of the support structure 220 there are 8 circular openings 221 for passing through the pin connectors 330 of the printed circuit board. Other breakthroughs present for accommodating bulky electronic components of the printed circuit board 30.

The frame element 40 comprises a circumferential edge 410 as well as several supporting ribs and is configured for receiving the planar frame-shaped microstrip antenna 50 and the touch-screen display 60. In assembled state, the antenna 50 is located at the backside 610 of the display 60 in physical contact with it. The outer dimensions of the antenna 50 are essentially identical to the out dimensions of the display 60. The stack consisting of the antenna 50 and the display 60 can be materially bonded to the frame 40. The frame 40 then can be attached to the housing frame 20 with ten snap-in connectors 420 that can engage with corresponding counterparts at the inner surface 211 of the side wall 210.

Frame element 40 and display 60 together form a front housing part.

Figure 2:
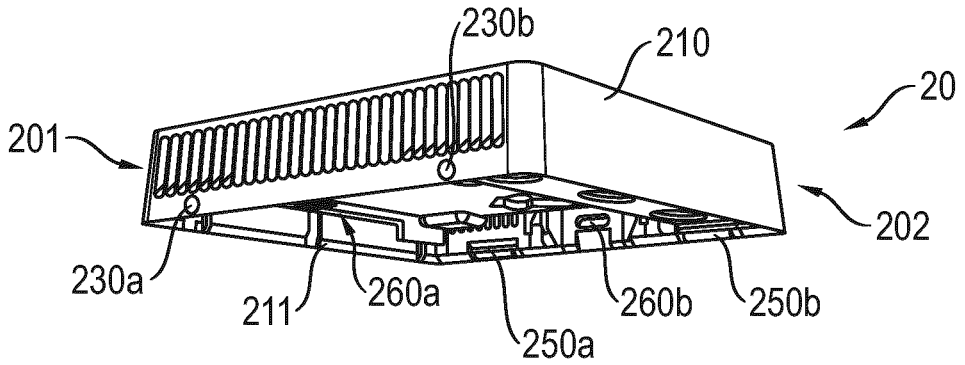
FIG. 2 depicts a perspective view of the part of the housing frame of FIG. 1.

FIG. 2 shows a view of housing frame 20 opposite the printed circuit board 30. At the inside of the upper side 202, the side wall 210 comprises two wedge-shaped protrusions, 250*a*, 250*b* projecting away from the inner surface of the side wall 210 towards an opposite inner surface of the housing frame 20.

Furthermore, there is a connection element 260*b* in the form of a recess between the two protrusions 250*a*, 250*b*, which is part of a mechanical snap-in connector for fixing the housing frame 20 to the mounting plate 10. At the side opposite of the protrusions 250*a*, 250*b*, there is a further connection element 260*a*, which is identical in design.

Figure 3:
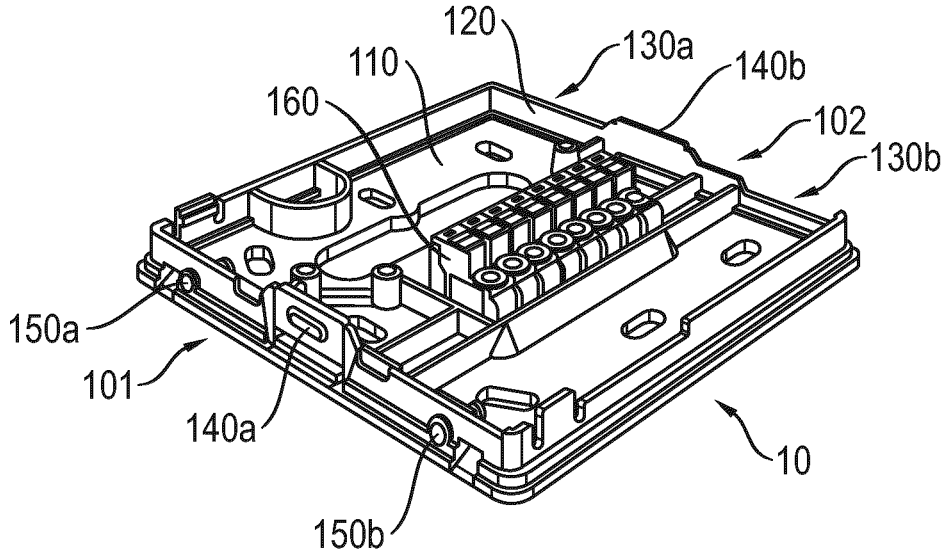
FIG. 3 depicts a mounting plate comprising a base plate with a circumferential rim projecting away perpendicularly from the base plate for use in room unit together with the components of FIG. 1.

FIG. 3 shows a mounting plate 10 comprising a square base plate 110 with a circumferential rim 120 projecting away perpendicularly from the base plate 110, whereby the rim is offset inwards from a circumferential edge of the base plate 110 by approximately a thickness of the side wall 210 of the mounting frame 20. The side wall 210 is configured for receiving the rim 120 of the mounting plate 10 with positive fit.

At the bottom side 101 (in vertical with respect to the installed state) of the rim 120, there are two headless screws 150*a*, 150*b* arranged in a nut behind the rim 120, whereby in a first position as shown in FIG. 3, the screws 150*a*, 150*b* are fully located below an outer surface of the rim 120 of the mounting 10 plate. If the rim 120 of the mounting plate 10 is received in the housing frame 20 and the screws 150*a*, 150*b* are brought in a second position, in which the screws 150*a*, 150*b* protrude outside the outer surface of the rim 120 into the corresponding bores 230*a*, 230*b*, the housing frame 20 is additionally secured to the mounting plate 10 in assembled state.

Additionally, in a central part of the bottom side 101 of the rim 120 there is a connection element 140*a* in the form of a bulge, which is configured to engage with the connection element 260*a* of the housing frame 20. Thereby, connection elements 140*a*, 260*a* form a snap-in connector.

At the central part of the upper side 102 (in vertical direction with regard to the installed state) of the rim 120 there is a further connector element 140*b*, which is identical in design and configured to engage with the connection element 260*b* of the housing frame 20, thus forming another snap-in connector.

The sections of the side wall 210 comprising the connector elements 260*a*, 260*b* are configure as break-out section.

At the upper side 102 of the rim, which is opposed to the bottom side 101, there are two spaced wedge-shaped protrusions 130*a*, 130*b* (not visible in FIG. 3; cf. FIG. 4) projecting away from an outer surface of the rim 120 in a direction parallel to the base plate 110.

Within the context of the present invention, protrusions 130*a*, 130*b* are called first protrusions and protrusions, 250*a*, 250*b* are called second protrusions.

Figure 5:
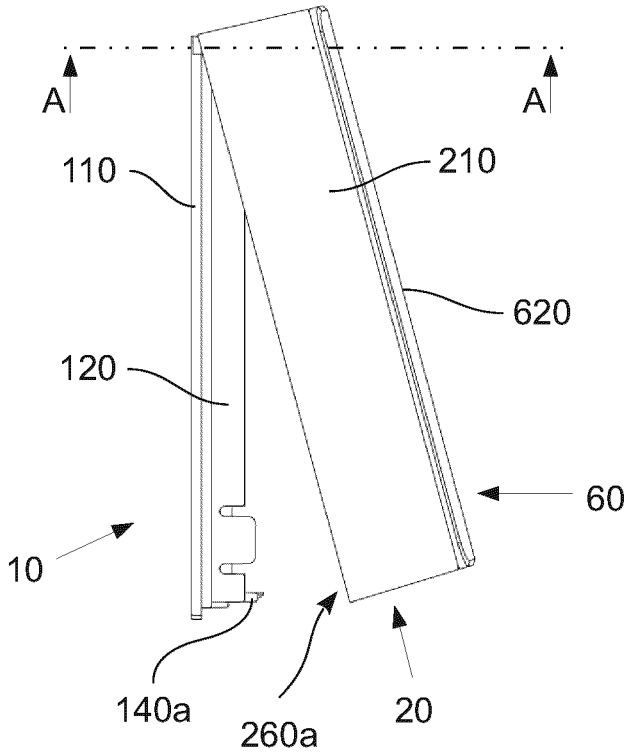
FIG. 5 depicts an intermediate state during the connection of the housing frame of FIG. 1 and the mounting plate of FIG. 3.
Figure 6:
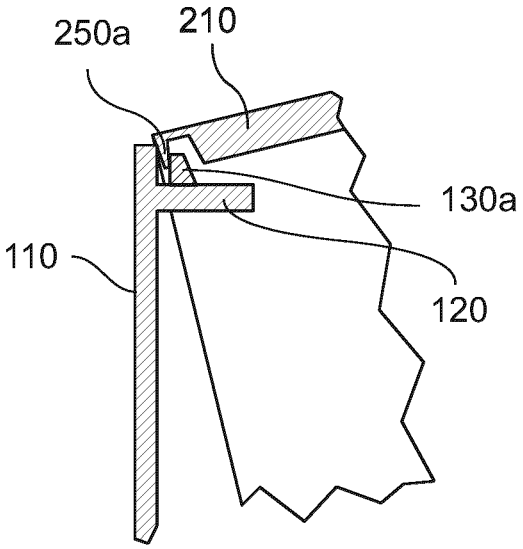
FIG. 6 depicts a detailed view of the interlocking between the housing frame and the mounting plate in the intermediate state shown in FIG. 5.
Figure 7:
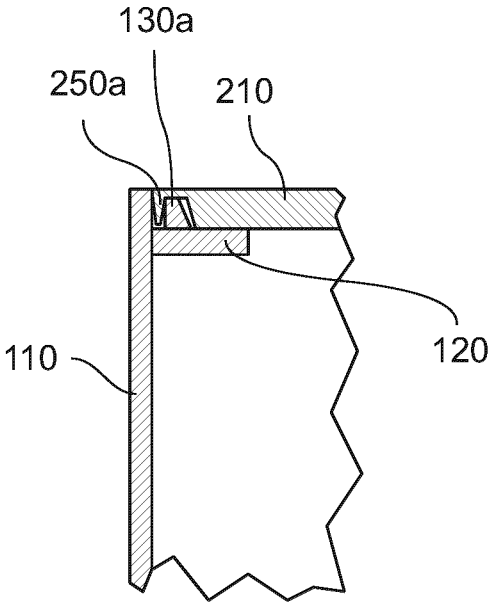
FIG. 7 depicts a detailed view of the interlocking between the housing frame and the mounting plate after pivoting the housing frame into the closes state.

The first protrusions 130*a*, 130*b* of the base plate and the respective second protrusions 250*a*, 250*b* of the housing frame 20 are configured in such a way that they can interlock with each other with a positive fit when the rim 110 of the mounting plate 10 is at least partly received in the circumferential side wall 210 of the mounting frame 20 (see FIGS. 5-7 for more details).

The sections of the rim 120 comprising the connector elements 140*a*, 140*b* are configured as break-out sections each with two predetermined breaking points.

Additionally, there is a socket 160 which is configured for receiving pin connectors 330 of the printed circuit board 30. They can be inserted into the socket 160 through the circular openings 221 in the support structure 220 in a direction perpendicular to the mounting plate 10.

Figure 4:
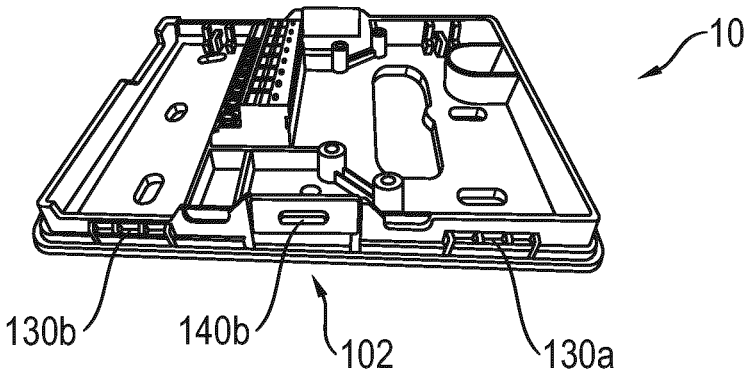
FIG. 4 depicts a top view onto the upper surface of the mounting plate of FIG. 3 with two first protrusions protruding away from the outer surface of the rim.

FIG. 4 shows a top view onto the upper surface 102 of the mounting plate 10, showing the first protrusions 130*a*, 130*b* protruding away from an outer surface of the rim 120 in a direction parallel to the base plate 110, i.e. in FIG. 4 into the direction of the viewer.

FIG. 5 shows an intermediate state during the connection process of the housing frame 20 and the mounting plate 10. Thereby, the components 30, 40, 50 and 60 have been attached to the housing frame 20 and the mounting plate has been fixed on a wall of a building (not shown) beforehand. Specifically, the housing frame 20 is hooked with its protrusions 250*a*, 250*b* onto the protrusions 130*a*, 130*b* protruding in vertical direction from the upper side of the rim 120 of the mounting plate 10. Thereby, the housing frame stands off at an angle with respect to the base plate 110 at an angle of for example 25.

FIG. 6 shows a detailed view of the interlocking between the first protrusion 130*a* and the second protrusion 130*b* in a cross-section of the upper left corner along line A-A of FIG. 5.

Thereafter, the housing frame 20 is pivoted around the interlocked protrusions 130*a*, 130*b*, 250*a*, 250*b* until the connection elements 140*a*, 260*a*, i.e. the snap-in connector, engage and, together with the interlocked connection elements 140*a*, 260*a*, secure the housing frame 20 to the mounting plate 10. The corresponding detailed view of this situation is shown in FIG. 7. Thereafter, the housing frame can be further secured with the screws 150*a*, 150*b* by bringing them in engagement with the bores 230*a*, 230*b*. In FIG. 12 a perspective view of the resulting room unit 1 in assembled state is shown.

In order to enable the pivoting motion, tolerances for the positive fit between the side wall 210 and the rim 120 of the mounting plate 10 are chosen accordingly. Furthermore the tolerances allow for pressing the housing frame in a direction perpendicular to the mounting plate 10, such that the protrusions 130*a*, 130*b*, 250*a*, 250*b* and the connection elements 140*a*, 260*a* can slip-over without prior hooking.

Figure 8:
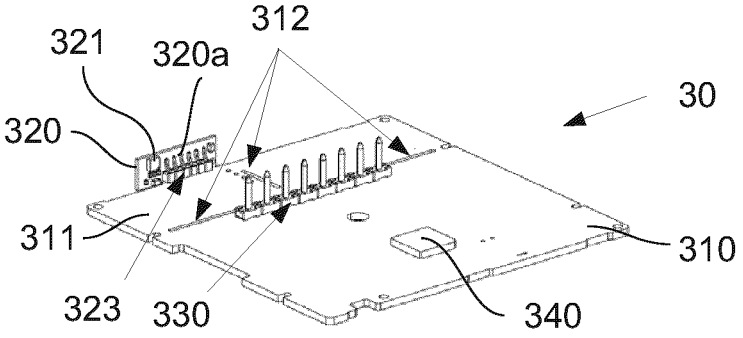
FIG. 8 depicts the printed circuit board comprising a first printed circuit board and a second printed circuit board protruding from an edge of the first printed circuit board in a direction perpendicular to the first printed circuit board.
Figure 9:
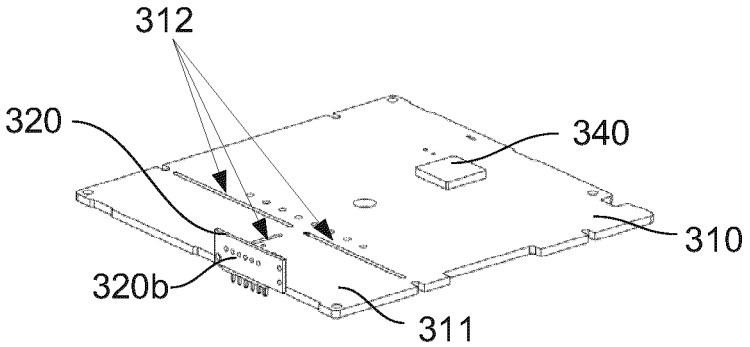
FIG. 9 depicts another view of the printed circuit board of FIG. 8.

FIGS. 8 and 9 show the printed circuit board 30 from different perspectives. As already mentioned, the printed circuit board 30 comprises the first printed circuit board 310 and the second printed circuit board 320 protruding from an edge of the first printed circuit board 310 in a direction perpendicular to the first printed circuit board 310. The second printed circuit board 320 is for example soldered to the first printed circuit board with pin connectors.

On the first printed circuit board 310, a controller 340 comprising a microprocessor and a memory is arranged, whereas on the front side 320*a* of the second printed circuit board 320, a combined sensor 321 for measuring temperature and humidity of ambient air is arranged.

In a central part, there are 8 pin connectors 330 protruding in a direction perpendicular to the first printed circuit board 310.

A first section 311 of the first printed circuit board 310, in which the second printed circuit board is installed, is separated from the section comprising the controller 340 by slit-shaped openings 312 for thermally decoupling the two sections.

The backside 320*b* of the second printed circuit board 320 is coated with a copper coating having a thickness of for example 35 m essentially on the entire surface area.

Figure 10:
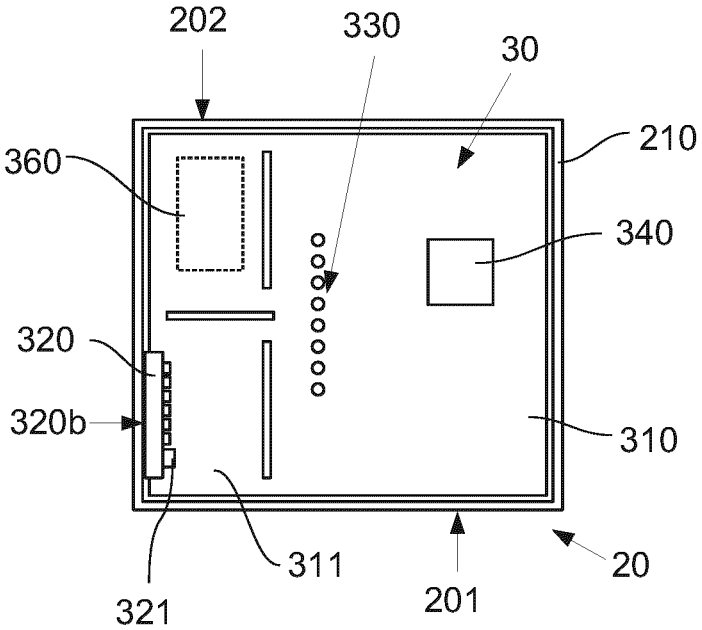
FIG. 10 depicts a top view on the printed circuit board of FIGS. 8 and 9 installed in the housing frame of FIG. 1 from the side opposite the mounting plate (without frame element, antenna and display attached)

FIG. 10 shows a top view on the printed circuit board 30 installed in the housing frame 20 from the side opposite the mounting plate (without frame element 40, antenna 50 and display 60 attached). In the lower left corner in FIG. 10, the backside 320*b* of the second printed circuit board 320 is in physical contact with the inner surface of the side wall 210 of the housing frame 20 in order to achieve a thermal coupling. If desired, a further sensor 360, e.g. a $CO_2$ sensor can be arrange in section 311, which preferably is isolated from the second printed circuit 320 and the controller by slit-shaped opening.

If the room unit is installed as intended with the bottom surface 201 of the housing pointing towards the floor and the upper surface 202 pointing towards the ceiling of the building, any ascending heat produced by the controller and the optional further sensor will not flow around the second printed circuit board.

Figure 11:
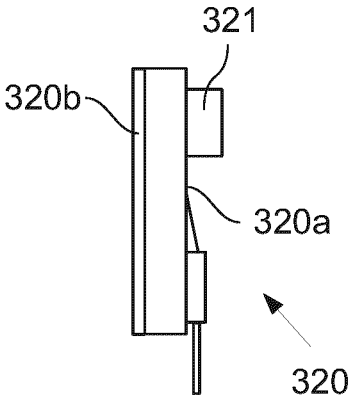
FIG. 11 depicts a detailed view of the second printed circuit board from a face side.

FIG. 11 shows a detailed view of the second printed circuit board 320 from a face side.

FIG. 12 shows a perspective view of the room unit 1 comprising the components as shown in FIG. 1-11 in assembled state.

Figure 13:
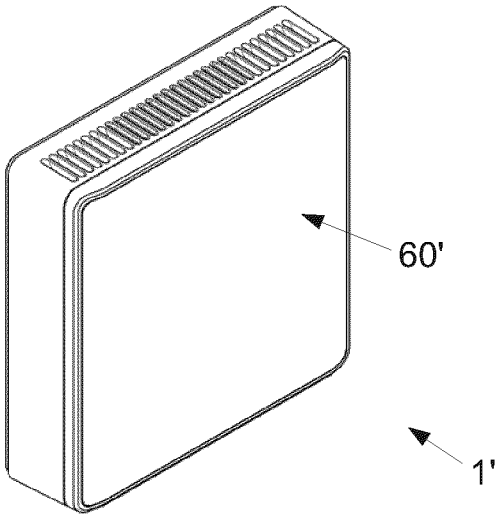
FIG. 13 depicts a further room unit comprises a blind cover as front housing part instead of a display.

FIG. 13 shows a further room unit 1', which is essentially identical in design with room unit 1. However, instead a display 60, the room unit 1' comprises a blind cover 60'.

Figure 14:
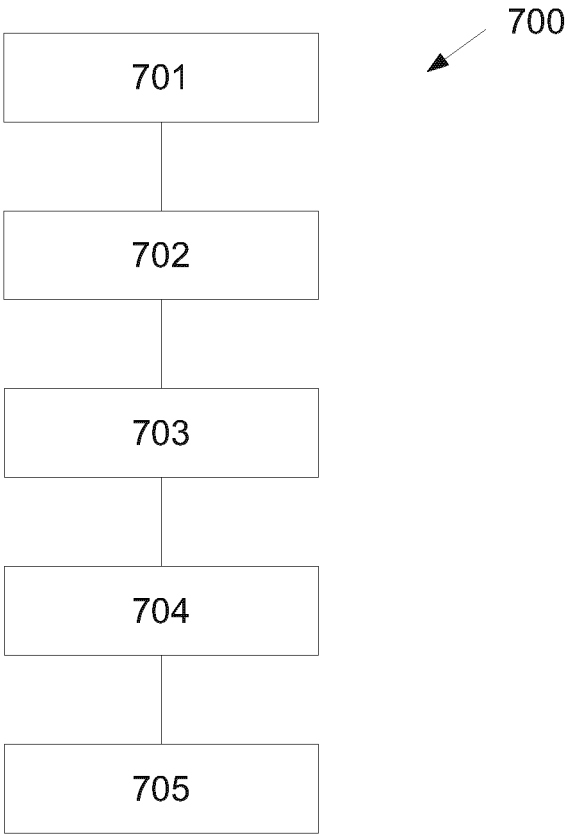
FIG. 14 depicts a schematic representation of a method for installing the room units of FIGS. 12 and 13 on a wall of a building.

FIG. 14 shows a method 700 for installing the room unit of FIG. 12 or 13, whereby in a first step 701, the front housing part, i.e. the frame element 40, the antenna 50 and display 60 or the blind cover 60', is attached to the housing frame 20 and thereby the housing frame 20 is closed at the free end.

In a second step 702, the mounting plate 10 is fixed on a wall of a building, whereby the mounting plate is arranged such the first protrusions 130*a*, 130*b* of the mounting plate 10 are located on an upper outer surface of the rim 120.

In a third step 703, the housing frame 20 is attached at the upper side 102 of the mounting plate 10, such that the second protrusions 250*a*, 250*b* of the housing frame 20 interlock with the first protrusions 130*a*, 130*b* in a positive manner and the housing frame 20 stands off the mounting plate 10 at an angle in FIG. 5.

Subsequently, in a fourth step 704, the housing frame 20 is pivoted around the interlocked protrusions 130*a*, 130*b*, 250*a*, 250*b* in order to entirely receive the rim 120 of the mounting plate 10.

In a fifth step 705, the housing frame 20 is secured to the mounting plate 10 with the connection elements 140*a*, 260*a*. Thereafter, the housing frame can be further secured with the screws 150*a*, 150*b* by bringing them in engagement with the bores 230*a*, 230*b*.

Of course, installation furthermore includes connecting electrical cables from the HVAC system to the socket 160.

Thus, it will be appreciated by those skilled in the art that the present invention can be embodied in other specific forms without departing from the spirit or essential characteristics thereof. The presently disclosed embodiments are therefore considered in all respects to be illustrative and not restricted.

In summary, it is to be noted that the invention provides highly beneficial room units which are compact in size and as easy to install and maintain. In particular the room units are resistant in case of incorrect handling during installation and maintenance and, despite the compact size, the room unit furthermore is capable to reliably measure ambient air parameters, especially ambient temperature, in the controlled room, space or zone.

The scope of protection of the present invention is given by the claims and is not limited by the features illustrated in the description or shown in the figures.

We claim:

1. A room unit for an HVAC system comprising a connection means to connect the device to the HVAC system, a controller and a housing, whereby the housing comprises:

a) a mounting plate configured to install the room unit on a wall of a building, wherein the mounting plate comprises a base plate with a circumferential rim projecting away perpendicularly from the base plate, and wherein the mounting plate comprises at least one first protrusion projecting away from an outer surface of the rim in a direction parallel to the base plate;

b) a housing frame configured to be attached to the mounting plate, wherein the housing frame comprises a circumferential side wall that laterally surrounds the inside of the room unit, and wherein the side wall is configured to receive the rim of the mounting plate with positive fit; wherein the housing frame comprises at least one second protrusion projecting away from an inner surface of the side wall towards an opposite inner surface of the housing frame; wherein the at least one first protrusion of the mounting plate and the at least one second protrusion of the housing frame are configured such that they interlock with each other with a positive fit when the rim of the mounting plate is at least partly received in the circumferential side wall of the mounting frame;

c) at least one mechanical connector arranged at a side opposite to the at least one first and second protrusions and configured to secure the housing frame to the mounting plate when the at least one first and the second protrusions are interlocked in a positive fit and the rim of the mounting plate is entirely received in the mounting frame, and d) a front housing part configured to close the housing frame at a free end opposite the mounting plate.

2. The room unit according to claim 1, wherein, with respect to an installed state of the room unit, the at least one first protrusion of the mounting plate is arranged on an upper outer surface of the rim and the at least one second protrusion of the housing frame is arranged on an upper inner surface of the side wall and wherein, with respect to an installed state of the room unit, the at least one mechanical connector is arranged at a bottom side of the housing.

3. The room unit according to claim 1, wherein the mechanical connector comprises a snap-in connector comprising a first connection element arranged at the mounting plate or at the rim, and a second connection element arranged at the housing frame or at the side wall of the housing frame.

4. The room unit according to claim 1, wherein the mechanical connector comprises at least one screw or at least two screws configured to secure the housing frame to the mounting plate.

5. The room unit according to claim 4, wherein the at least one screw is arranged in the rim of the mounting plate or in a nut, and the housing frame comprises at least one bore, wherein, in a first position, the screw is fully located below an outer surface of the rim of the mounting plate, and, in a second position, the screw protrudes outside the outer surface of the rim, wherein, if the rim of the mounting plate is received in the housing frame and the screw is brought into the second position, the at least one screw protrudes into the at least one bore for securing the housing frame to the mounting plate.

6. The room unit according to claim 1, wherein the mounting plate and the housing frame are configured such that the first and the second protrusions are arranged and configured to interlock in a positive manner while the housing frame stands off at an angle or an angle of 5-45 with respect to the base plate and the housing frame is configured to pivot around the interlocked protrusions, in order to entirely receive the rim of the mounting plate and to secure the housing frame to the mounting plate with the mechanical connector or the snap-in connector and/or the at least one screw.

7. The room unit according to claim 1, wherein the mounting plate and the housing frame are configured such that, if the housing frame is pressed onto the mounting plate in a direction perpendicular to the base plate and with an orientation parallel to the base plate, the at least one first protrusion snaps on the at least one second protrusion in order to interlock the protrusions in a positive manner and simultaneously the rim of the mounting plate is received in the circumferential side wall of the mounting frame such that the housing frame is or can be secured to the mounting plate.

8. The room unit according to claim 1, wherein the controller is arranged on a printed circuit board comprising one or more pin connectors arranged and configured to connect the controller to the connection means.

9. The room unit according to claim 8, wherein the mounting plate comprises the connection means and is configured to connect the device to the HVAC system or a connector for a bus system configured for a field bus system, and/or a socket configured to receive the one or more pin connectors of the printed circuit board.

10. The room unit according to claim 9, wherein the one or more pin connectors of the printed circuit board and the connection means are configured such that the one or more pin connectors can be inserted into the socket or through openings in the support structure, in a direction perpendicular to the base plate such that when attaching the housing frame to the mounting plate, the one or more pin connectors are automatically introduced into the socket.

11. The room unit according to claim 1, wherein the housing frame comprises a support structure or a tray configured to carry the controller or the printed circuit board with the controller arranged on it within an inner volume surrounded by the side wall or on a side of the support structure facing away from the wall and/or the mounting plate.

12. The room unit according to claim 1, wherein the room unit comprises at least one sensor configured to measure at least one parameter of ambient air.

13. The room unit according to claim 1, wherein the front housing part is a separate part of the housing which is configured to be fixed on the housing frame or with at least one snap-in connector.

14. The room unit according to claim 1, wherein the front housing part comprises a display or an electronic paper display, covered with a transparent cover, wherein the display is a touch-screen or is overlaid by a touch sensitive foil.

15. The room unit according to claim 1, comprising a short-range wireless communication module is configured to enable wireless communication with a mobile device for an exchange of data between the mobile device and the room unit and wherein an antenna of the short-range wireless communication module is arranged behind a display or in physical contact with a backside of the display.

16. The room unit according to claim 15, wherein the antenna is a planar antenna, or a microstrip antenna and/or a foil antenna, comprising conductive antenna elements in and/or on a substrate in the form of a plastic foil.

17. The room unit according to claim 15, wherein outer dimensions of the antenna are equal to or smaller than a size of the display.

18. The room unit according to claim 15, wherein a front housing part comprises a frame element configured to carry a display, a transparent cover, a touch sensitive foil, and/or the antenna, wherein, the frame comprises snap-in connection means configured to connect the frame element to the housing frame.

19. The room unit according to claim 1, wherein the at least one first protrusion, at a side opposite the base plate, has a sloped surface, which slopes in a direction away from the outer surface of the rim and/or the at least one second protrusion, at a side facing the mounting plate, has a sloped surface, which slopes in a direction away from the side wall, such that the housing frame can slip-over the mounting plate when the housing plate is pressed onto the mounting plate in a direction perpendicular to the base plate and with an orientation parallel to the base plate.

20. The room unit according to claim 1, wherein the rim is offset inwards from a circumferential edge of the base plate such that a protruding edge of the base plate forms a flange, which serves as a stop for the side wall of the housing frame.

* * * * *